US011122940B1

(12) United States Patent
Winn

(10) Patent No.: US 11,122,940 B1
(45) Date of Patent: Sep. 21, 2021

(54) WRIST-WORN SANITIZER DISPENSER

(71) Applicant: George Joseph Winn, Falls Church, VA (US)

(72) Inventor: George Joseph Winn, Falls Church, VA (US)

( * ) Notice: Subject to any disclaimer, the term of this patent is extended or adjusted under 35 U.S.C. 154(b) by 0 days.

(21) Appl. No.: 17/128,332

(22) Filed: Dec. 21, 2020

Related U.S. Application Data

(60) Provisional application No. 63/053,063, filed on Jul. 17, 2020.

(51) Int. Cl.

| | |
|---|---|
| ***B65D 35/46*** | (2006.01) |
| ***B65D 35/24*** | (2006.01) |
| ***B65D 35/10*** | (2006.01) |
| ***A45F 5/00*** | (2006.01) |
| ***A47K 5/122*** | (2006.01) |
| *B65D 75/58* | (2006.01) |
| *B65D 83/00* | (2006.01) |

(52) U.S. Cl.
CPC ..... *A47K 5/122* (2013.01); *A45F 5/00* (2013.01); *A45F 2005/008* (2013.01); *B65D 35/10* (2013.01); *B65D 35/24* (2013.01); *B65D 35/46* (2013.01); *B65D 75/5883* (2013.01); *B65D 83/0055* (2013.01)

(58) Field of Classification Search
CPC ..... A45F 2005/008; A47K 1/22; A47K 5/122; B65D 83/0055; B65D 35/00; B65D 35/02; B65D 35/10; B65D 35/24; B65D 35/28; B65D 35/44; B65D 35/46; B65D 75/5883
USPC ..... 222/175; 383/906
See application file for complete search history.

(56) References Cited

U.S. PATENT DOCUMENTS

| | | | | | |
|---|---|---|---|---|---|
| 299,228 | A | * | 5/1884 | Kirsten | B29C 48/06 425/191 |
| 1,881,086 | A | | 10/1932 | Marshall | |
| 2,021,609 | A | * | 11/1935 | Pippert | B65D 33/1666 383/69 |
| 2,161,516 | A | * | 6/1939 | Jung | B65D 35/28 222/99 |
| 2,235,350 | A | * | 3/1941 | Anderson | A44C 15/002 224/148.7 |
| 3,344,963 | A | * | 10/1967 | Wynes | B65D 35/46 222/495 |
| 3,791,098 | A | * | 2/1974 | Webster | B65D 83/682 53/452 |
| 4,729,496 | A | * | 3/1988 | Davidson | B65D 35/32 222/107 |
| 4,736,876 | A | | 4/1988 | Kriss | |
| 4,817,823 | A | * | 4/1989 | Sparr, Sr. | B65D 35/28 222/103 |

(Continued)

FOREIGN PATENT DOCUMENTS

| | | |
|---|---|---|
| GB | 2553500 | 3/2018 |
| WO | 2009/088964 | 7/2009 |

*Primary Examiner* — Justin M Larson
(74) *Attorney, Agent, or Firm* — Benjamin C. Rothermel, Esq.

(57) ABSTRACT

A dispenser includes a holster having a first ply and a second ply, a reservoir having a first sheet and a second sheet connected at edges thereof, and a dispensing aperture arranged between the first sheet and the second sheet, wherein the second ply forms a pocket on the first ply, and the reservoir is arranged in the pocket between the first ply and the second ply.

10 Claims, 9 Drawing Sheets

(56) References Cited

U.S. PATENT DOCUMENTS 4,909,434 A * 3/1990 Jones ..... B29C 65/08 220/258.2
4,974,762 A * 12/1990 Boretsky ..... A45C 1/04 224/148.2
5,058,771 A * 10/1991 Curtis ..... B65D 35/32 222/99
D323,430 S * 1/1992 Niederkorn ..... 224/221
5,125,886 A * 6/1992 Dirksing ..... B29C 65/02 264/248
5,205,438 A * 4/1993 Southard ..... B65D 35/28 222/1
5,222,629 A * 6/1993 Tal ..... B65D 35/28 222/103
5,226,564 A * 7/1993 Steer ..... A61F 5/4404 222/107
5,277,335 A * 1/1994 Okami ..... B65D 35/28 222/102
5,501,369 A * 3/1996 Tal ..... B65D 35/28 222/103
5,549,221 A * 8/1996 Conlee ..... B65D 35/28 222/103
5,683,012 A * 11/1997 Villaveces ..... A45F 5/02 222/175
5,855,544 A * 1/1999 Buchanan ..... B29C 66/65 493/102
5,868,282 A * 2/1999 Imhoff ..... B65D 35/28 222/101
5,938,089 A * 8/1999 Abreu-Marston ..... A45F 3/20 215/382
5,983,460 A * 11/1999 Hyde ..... B65D 33/1666 24/30.5 R
6,155,458 A * 12/2000 Picard ..... B65D 35/28 222/103
6,173,866 B1 * 1/2001 Taylor, Jr. ..... A45F 3/20 222/175
6,241,122 B1 * 6/2001 Araki ..... B65D 47/06 222/107
6,247,619 B1 * 6/2001 Gill ..... B62J 9/26 222/105
6,672,478 B1 * 1/2004 Fox ..... B65D 35/28 222/1
6,749,087 B1 * 6/2004 Robinson ..... B65D 35/28 222/1
D501,990 S * 2/2005 Carr ..... D3/215
6,860,406 B2 * 3/2005 Kobetsky ..... B29C 65/18 222/92
6,966,457 B1 * 11/2005 Torbet ..... B65D 35/285 222/101
6,981,614 B2 * 1/2006 Niggemyer ..... B65D 75/5883 222/107
7,004,354 B2 * 2/2006 Harper ..... B65D 75/30 222/212
7,135,011 B2 11/2006 Powers et al.
7,222,751 B2 * 5/2007 Kerman ..... B65D 35/46 222/494
D544,096 S * 6/2007 Walters ..... D24/121
7,284,681 B2 * 10/2007 Hagihara ..... B65D 47/2018 222/107
D560,122 S * 1/2008 Fuchs ..... D9/708
7,316,332 B2 1/2008 Powers et al.
D574,241 S * 8/2008 Braukmann ..... D9/453
7,597,122 B1 * 10/2009 Smith ..... A47K 5/1202 141/114
7,661,560 B2 * 2/2010 Murray ..... B65D 75/5866 222/107
7,735,682 B1 * 6/2010 Cassel ..... A47K 10/38 221/185
7,794,149 B2 * 9/2010 Wilkes ..... B65D 75/5883 383/120
D641,243 S * 7/2011 Golias ..... D9/456
8,046,878 B1 * 11/2011 Matrejek ..... B65D 33/1666 24/30.5 L
8,328,047 B2 * 12/2012 Walters ..... B65D 83/62 222/95
8,613,548 B2 * 12/2013 Murray ..... B65D 75/5883 383/121
8,747,008 B2 * 6/2014 Geesbreght ..... A47K 5/12 401/180
8,973,788 B1 * 3/2015 Burns ..... A47K 5/1201 222/175
9,051,078 B2 * 6/2015 Martini ..... B65D 5/746
9,113,699 B2 * 8/2015 Radosta ..... A45F 3/20
D738,724 S * 9/2015 Schick ..... D9/447
9,238,539 B2 * 1/2016 Lynch ..... B65D 75/5877
9,402,454 B2 8/2016 Landy
9,451,797 B1 * 9/2016 Ashkanani ..... A41D 19/002
9,578,935 B2 2/2017 Horgan
9,874,899 B2 * 1/2018 Oliveira ..... G06F 1/1626
9,878,350 B2 1/2018 Landy
D811,729 S * 3/2018 Bysshe ..... D3/218
9,926,123 B2 * 3/2018 Lynch ..... A45F 5/00
9,968,179 B2 * 5/2018 Patel ..... A44C 5/003
10,005,261 B2 * 6/2018 Stanley ..... B32B 27/30
10,098,443 B2 * 10/2018 Butler ..... A45C 13/30
10,203,719 B2 * 2/2019 Oliveira ..... G06F 1/16
10,264,859 B2 * 4/2019 Parker ..... A44C 25/002
10,392,161 B2 * 8/2019 Berge ..... B65D 41/0485
10,427,860 B2 * 10/2019 Regnier ..... B65D 35/10
10,463,139 B2 * 11/2019 Sola ..... A41D 27/10
10,646,076 B2 * 5/2020 Shaukat ..... B05B 9/085
10,737,872 B2 * 8/2020 Kinarti ..... A45F 5/02
D895,934 S * 9/2020 Ott ..... D2/857
2004/0111071 A1 6/2004 Powers et al.
2004/0124210 A1 * 7/2004 Bartiein ..... B65D 75/5872 222/92
2005/0087551 A1 * 4/2005 Reid ..... A45F 3/20 222/160
2005/0247727 A1 * 11/2005 Mahurin ..... B65D 35/46 222/101
2006/0091156 A1 5/2006 Powers et al.
2006/0186140 A1 * 8/2006 Kanfer ..... B05B 11/0041 222/207
2006/0192031 A1 8/2006 Yeung
2006/0204693 A1 * 9/2006 Dambricourt ..... B65D 35/08 428/35.7
2007/0088298 A1 4/2007 Powers et al.
2007/0127854 A1 * 6/2007 Smith ..... B65D 75/30 383/66
2007/0131710 A1 * 6/2007 Requardt ..... B65D 35/28 222/103
2008/0041890 A1 * 2/2008 Masuda ..... B65D 35/14 222/496
2008/0067193 A1 3/2008 Powers et al.
2008/0110773 A1 * 5/2008 Greep ..... A61M 35/10 206/205
2008/0193495 A1 * 8/2008 Kharazmi ..... A45F 5/00 424/404
2008/0251539 A1 10/2008 Yapaola et al.
2010/0287745 A1 * 11/2010 Hill ..... B65D 35/28 24/457
2011/0139823 A1 * 6/2011 Staudt ..... A41D 20/00 222/175
2011/0155765 A1 * 6/2011 Properzi ..... A47K 5/1201 222/175
2011/0210122 A1 * 9/2011 Benoit-Gonin ..... B65D 41/3447 220/277
2012/0024858 A1 * 2/2012 Sholes ..... B65D 51/1616 220/367.1
2012/0102885 A1 * 5/2012 Sharp ..... B65B 3/02 53/452
2012/0241465 A1 * 9/2012 Genosar ..... B05B 11/048 222/1
2012/0282011 A1 * 11/2012 Francois ..... A61L 2/18 401/196
2013/0104599 A1 * 5/2013 Beldiman ..... A44C 5/003 63/1.14
2013/0221037 A1 * 8/2013 Klenovich ..... B65D 35/00 222/420

(56) References Cited

U.S. PATENT DOCUMENTS

| | | | | |
|---|---|---|---|---|
| 2013/0292395 | A1* | 11/2013 | Stanley | B32B 7/12 220/645 |
| 2015/0158042 | A1* | 6/2015 | Parker | A44C 5/003 222/175 |
| 2016/0339483 | A1 | 11/2016 | Landy | |
| 2017/0341820 | A1* | 11/2017 | Folkmar | B65D 31/18 |
| 2020/0140189 | A1* | 5/2020 | Austin | B65D 85/8043 |
| 2020/0164400 | A9 | 5/2020 | Landy | |
| 2020/0209912 | A1* | 7/2020 | Oliveira | G06F 1/1626 |
| 2020/0260917 | A1* | 8/2020 | Matthews | A47K 5/1201 |

* cited by examiner

10

200

WRIST-WORN SANITIZER DISPENSER

CROSS-REFERENCE TO RELATED APPLICATION

This application claims benefit of U.S. Provisional Patent Application No. 63/053,063, filed on Jul. 17, 2020, which is hereby incorporated by reference for all purposes as if fully set forth herein.

BACKGROUND

Field

Exemplary embodiments relate to dispensers providing a convenient method for applying hand sanitizer.

Discussion of the Background

The emergence of the COVID-19 viral pandemic within the United States, in January 2020, revealed shortcomings of personal protective equipment as well as agreed upon guidance regarding proper hygienic measures to protect oneself from contraction of the virus.

The Centers for Disease Control issued seven recommendations to the general public of the U.S. on Mar. 27, 2020. The first recommendation cited was to wash your hands frequently. The second one cited was to "avoid touching your eyes, nose, and mouth with unwashed hands." Other recommendations were manageable such as keeping a six-foot distance between persons and wearing a face mask. Washing one's hands however can be quite problematic when performing functions in public such as shopping and traveling to work. Every door, shopping cart, gas pump handle, subway hand grip and elevator button could conceivably be contaminated with COVID-19 or other pathogens.

Although normal in other countries, the use of face masks in the U.S. was not customary until recently. The lowering of this barrier, due to possible infection, has not only been encouragement for all to wear a mask, it has been seen as respectful to others who may come in close proximity to the wearer. However, touching one's face may result from an involuntary response to itch, sweat, dry an eye, or a need to adjust ones glasses or face mask. Keeping a six foot distance, wearing a mask, and washing ones hands is a voluntary action but may not sufficiently reduce the chance of tainting the face with contaminated hands.

Alcohol-based disinfectants have been found to be an effective way of eliminating pathogens such as COVID-19. Hand disinfectants are marketed in a range of viscosities from 95% alcohol (liquid) to gel-based mixtures. The gel-based disinfectants may have a viscosity up to 300 times that of pure ethyl alcohol when mixed with 35% glycerin to 65% alcohol, so a dispenser with broad utility may be needed to accommodate a large range of viscosities.

Members of the general public may rely solely on having wash stations nearby such as at restaurants and commercial outlets. Many persons may carry small amounts of sanitizer with them. However, it may be inconvenient to locate wash stations, and reaching into one's pocket or pocket book to retrieve and use a portable bottle of sanitizer may promote the spread of viruses to personal items.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a dispenser providing a convenient method for applying hand sanitizer.

Exemplary embodiments also provide a wrist-worn dispenser providing a convenient method for applying hand sanitizer.

Additional aspects will be set forth in the detailed description which follows, and, in part, will be apparent from the disclosure, or may be learned by practice of the inventive concept.

According to an exemplary embodiment, a dispenser includes a reservoir having a first sheet and a second sheet connected at edges thereof, and a dispensing aperture arranged between the first sheet and the second sheet.

According to an exemplary embodiment a dispenser includes a holster having a first ply and a second ply, a reservoir having a first sheet and a second sheet connected at edges thereof, and a dispensing aperture arranged between the first sheet and the second sheet, wherein the second ply forms a pocket on the first ply, and the reservoir is arranged in the pocket between the first ply and the second ply.

According to an exemplary embodiment a clip includes a body having a tubular shape and a channel formed through the body and extending along an entire length thereof.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
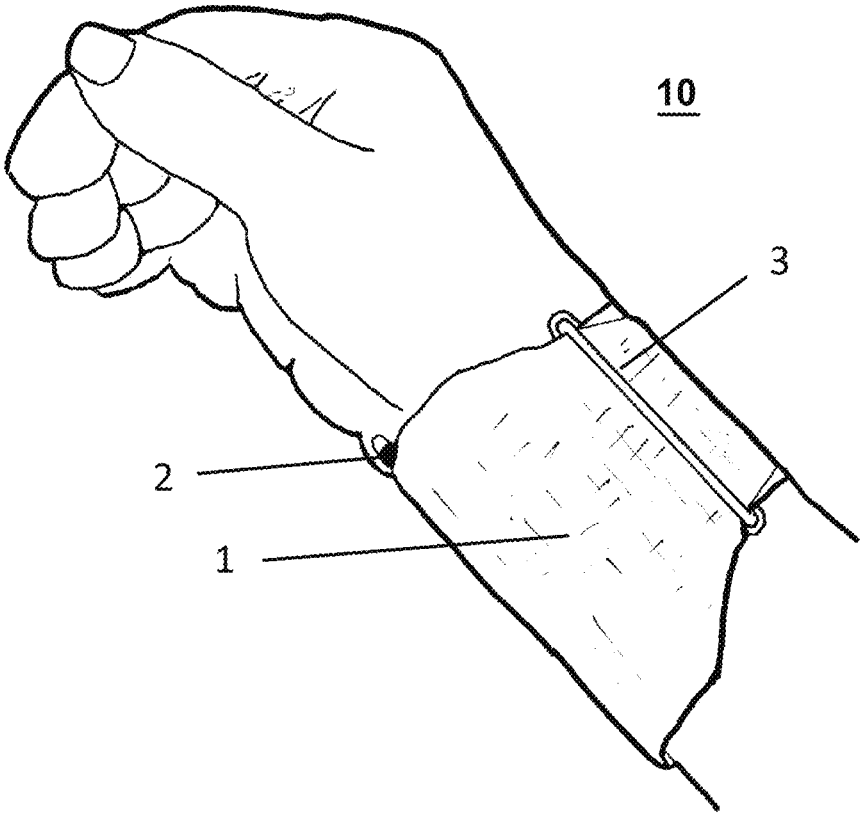
FIG. 1 is a perspective view of a dispenser according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

An exemplary embodiment relates to a dispenser 10, as shown FIG. 1, FIG. 8, FIG. 9, FIG. 10 and FIG. 11. According to the present exemplary embodiment, the dispenser 10 includes a holster 1 to allow the dispenser to be wrist-worn, for dispensing sanitizer. The holster 1 may be made of a synthetic or natural fabric or plastic sheet and secured to a user's wrist using a buckle 3 and hook 21 and loop 20 fastener. A valve 2 extends from the holster 1 and may be directed towards the user's palm of hand.

Figure 2:
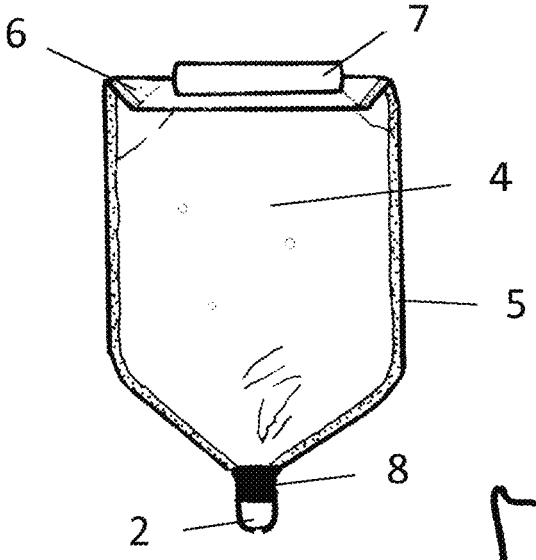
FIG. 2 is a front view of a bladder according to the present exemplary embodiment.
Figure 3:
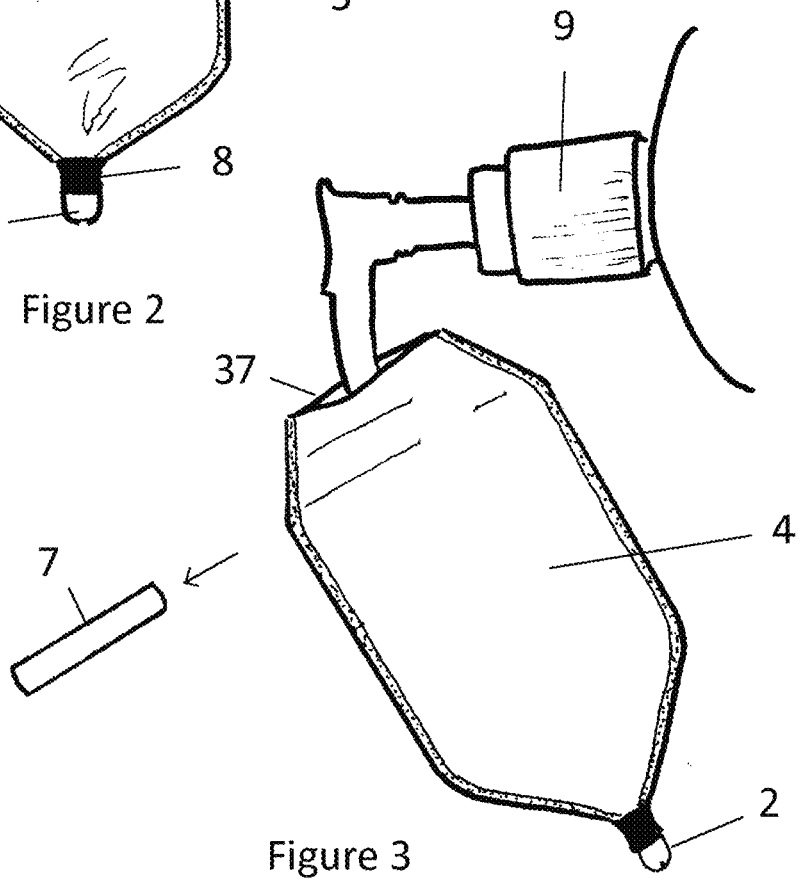
FIG. 3 is a front view of the bladder of FIG. 2 being refilled with hand sanitizer.

The holster 1 has a bladder 4 arranged therein. The bladder 4 is shown in FIG. 2 and FIG. 3. The body of the bladder 4 is fabricated from two plies of sheet plastic such as polystyrene of polypropylene and is heat welded together at a seam 5. The bladder may also be fabricated using a blow mold technique. According to the present exemplary embodiment, the bladder 4 is a two-ply, heat welded six mil polypropylene material capable of containing fifteen cubic centimeters of hand sanitizer fluid of varying viscosity. The bladder 4 provides a contained environment using a check valve-controlled, dispensing duct at one end thereof, and a refill opening 37 at the opposite end thereof. The valve 2 is secured to the bladder 4 using shrink wrap tubing 8 compressed over the bladder plies, forcing them into a groove located on the valve body (described below with respect to FIGS. 5-7*b* and 16*a*-16*d*). The bladder 4 has a flap 6, and a clip 7 is slid over the flap 6 to secure and seal the bladder 4 opening 37.

FIG. 3 demonstrates how the bladder 4 is filled with fluid according to the present exemplary embodiment. The clip 7 is removed from the flap 6 of the bladder 4. The flap 6 is unfolded and separated to expose the opening 37. The sides of the bladder 4 are then squeezed using the thumb and index finger placed on the edges of the bladder 4 in order to expand the bladder 4. Sanitizer is then pumped into the bladder 4 to a level approximately two-thirds of the way up using a bottle with pump 9. The flap 6 is closed by folding the flap 6 back on itself twice with each fold being approximately one quarter inch in width. The clip 7 is then reinstalled by sliding it from one side and across the seam of the bladder 4.

Figure 4:
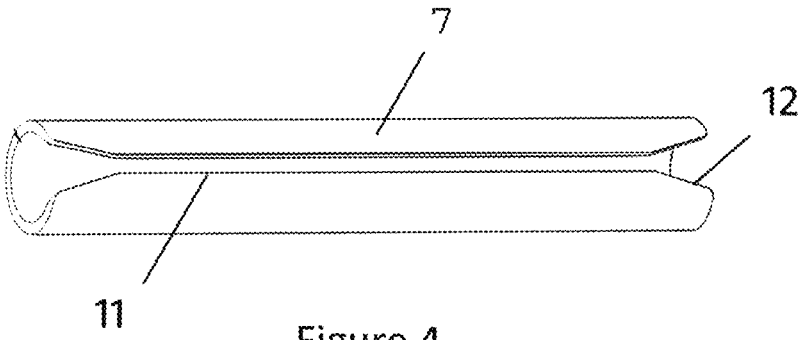
FIG. 4 is a perspective view of a clip according to the present exemplary embodiment.

The clip 7, as shown in FIG. 4, is made of a plastic material such as polyoxymethylene (acetal). A channel 11 is cut in the clip 7 and notched 12 at both ends of the clip 7 to facilitate insertion onto the flap 6. A label embossed or stamped may carry brand, writing or technical information. According to further exemplary embodiments, the clip 7 may be used for restraining any multiple-ply sheet material such as tooth paste or cosmetic tubes to prevent the paste from moving away from the nozzle when being squeezed.

As shown in FIG. 5, FIG. 6, FIG. 7*a* and FIG. 7*b*, the valve 2 is a pressure valve having a body made of polyoxymethylene and that includes a polyoxymethylene ball 13 and a spring 17. Ball diameter and properly adjusted spring force is used to realize the optimal pressure required to release fluid to a user's hand. The valve 2 pressure release mechanism may alternatively be made of a cross-slotted diaphragm or other technique that would restrict the flow of sanitizer fluid until a critical pressure level is obtained. The spring constant and aperture (ball to seat dimension) permits a reasonable pressure be applied in order to release the sanitizer without the problem of unintended release, slow weep or discharge requiring excessive applied pressure.

A cap 16, that contains a properly sized hole capable of retaining the ball 13, is affixed to the valve 2 body using a heat crimp 14 or cyanoacrylate adhesive. The valve 2 is adhered to the bladder 4 with the use of grooves 15*a* and 15*b* in the valve 2 that permits the unification of the bladder 4 to valve 2 using shrink tubing. This approach helps insure that no leakage takes place when pressure is exerted on the bladder 4, such as by using the fingers of an opposing hand. A vent 18 communicates fluid from bladder 4 to a user's palm.

Figure 5:
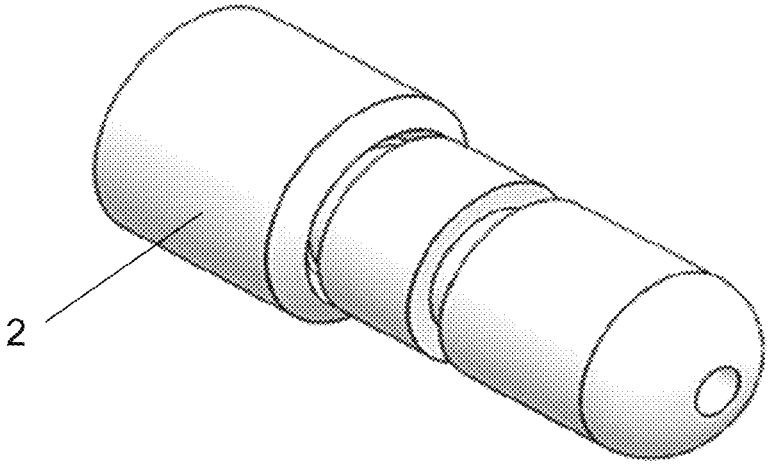
FIG. 5 is an isometric view of a valve according to the present exemplary embodiment.
Figure 6:
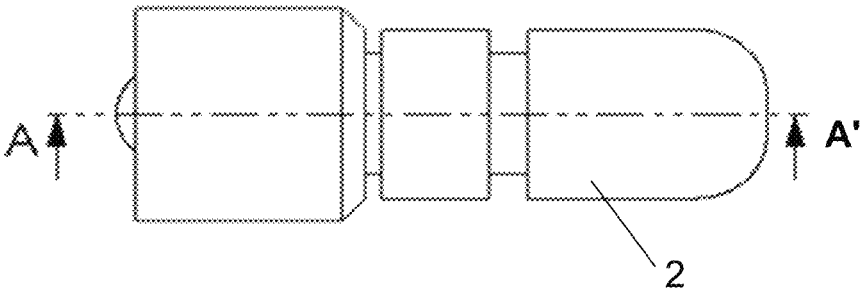
FIG. 6 is a side view of the valve of FIG. 5.
Figure 7A:
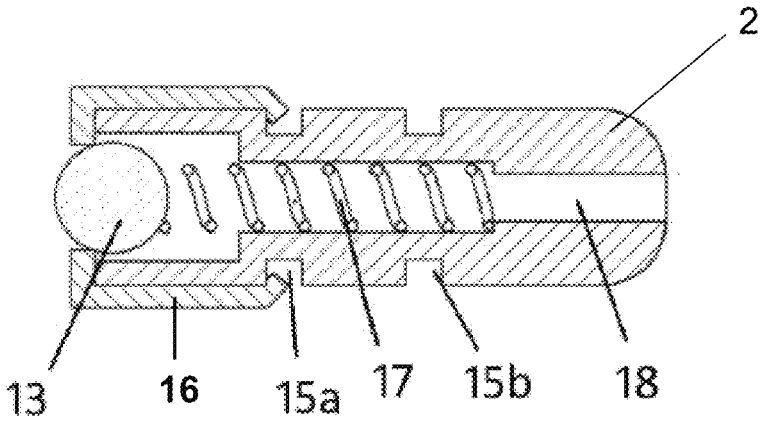
FIG. 7*a* and FIG. 7*b* are cross-sectional views of the valve taken along line A-A' of FIG. 6.
Figure 7B:
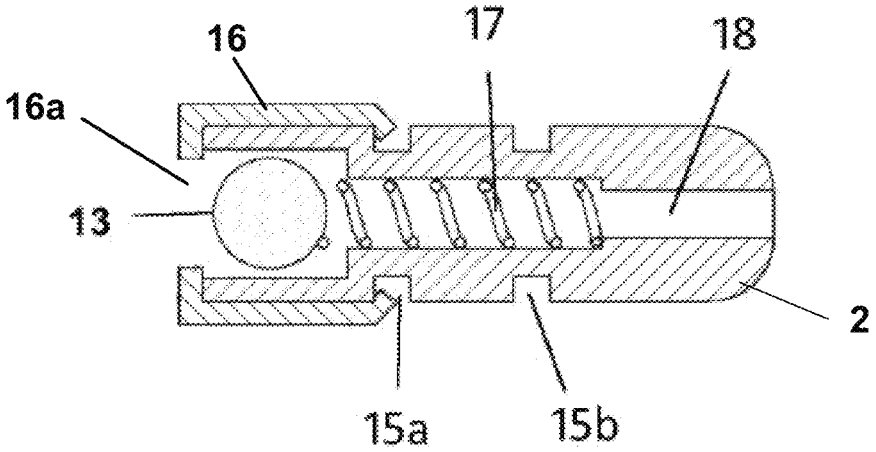

FIG. 7*a* and FIG. 7*b* are cross-sectional views of the valve 2 as shown in FIGS. 5 and 6 according to the present exemplary embodiment. A valve inlet chamber 16*a* is provided between the ball 13 and the valve chamber wall to allow fluid to pass when pressure is applied to the bladder 4 during operation, as shown in FIG. 7*b*. In conjunction with the size of the ball 13, the spring 17 was chosen with a k value (i.e., force rate) commensurate with the desired pressure to release the sanitizer fluid. The length of the spring 17 along with the length of the spring chamber allows adjustment of the spring tension to fine tune the optimal pressure release point. According to the present exemplary embodiment, the spring 17 has a compressed length greater than spring chamber length, which is intended to prevent a situation where a solid height (i.e., all windings compressed upon each other) may be reached causing restriction or stoppage of the fluid through the valve 2, such as by the ball 13 blocking fluid from flowing through the spring chamber.

Groove 15*a* is used in concurrence with the cap 16 allowing the cap to be sealed to the valve body using a heat crimp. Groove 15*b* performs two functions. First, it provides a pressure seal between the valve 2 and bladder 4 (as described with respect to FIGS. 16*a*-16*d* below) and second, it prevents the valve from moving back into the bladder 4, such as if the valve 2 is inadvertently forced backwards.

Figure 8:
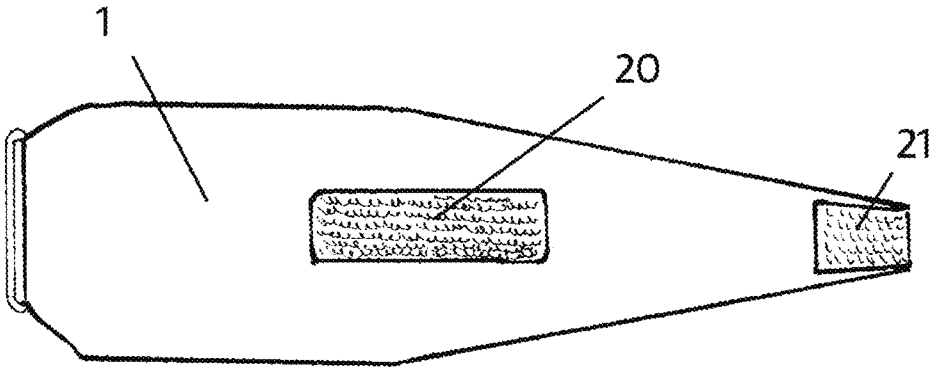
FIG. 8 is a top view of a holster according to the present exemplary embodiment.
Figure 9:
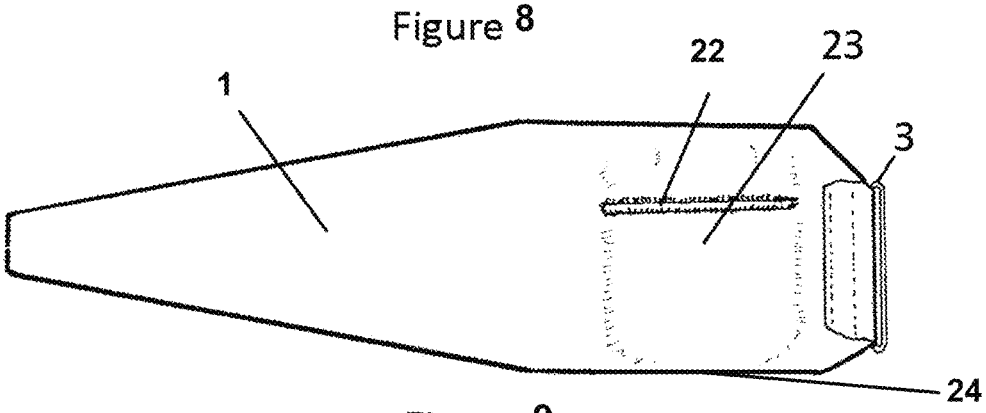
FIG. 9 is a bottom view of the holster of FIG. 9.

FIG. 8 is a top view of the holster 1 showing the hook 21 and loop 20 fastener. FIG. 9 is a bottom view of the holster 1 having a pocket 23 sewn thereon, the hook 21 affixed on a tapered end of the holster 1, and a buckle 3 affixed on the opposite end of the holster 1. The holster 1 is secured to a user by threading the holster 1 through a "D" ring of the buckle 3 and securing it with the hook 21 to the loop 20 sewn on the top side of the holster 1.

Figure 10:
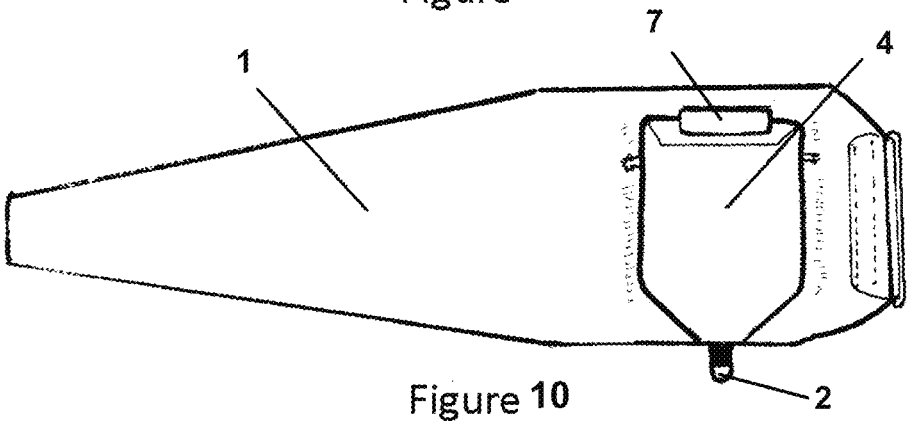
FIG. 10 is a bottom view of the holster of FIG. 9 and the bladder according to the present exemplary embodiment.

The pocket 23 is accessed by a first opening 22 about one-third of the way down the pocket 23, the first opening 22 perpendicularly orientated to the buckle 3. The pocket 23 also has a second opening 24 along the bottom edge of the holster 1 for the valve 2 to be exposed therethrough. The bladder 4 is inserted into the pocket 23, and may be completely enclosed in the pocket 23. FIG. 10 is a view of the bottom side of the holster 1 with the bladder 4 overlaid on the holster 1 to show the area that the bladder 4 occupies in the pocket 23.

Figure 11:
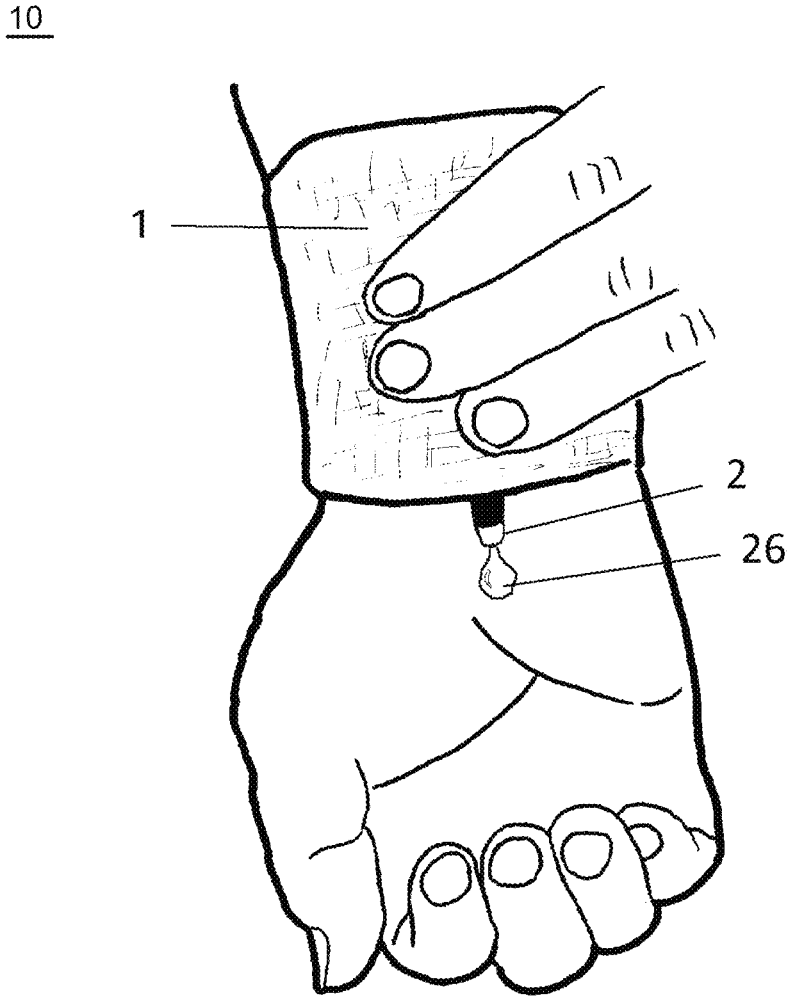
FIG. 11 shows the dispenser of FIG. 1 during use according to the present exemplary embodiment.

The method for dispensing hand sanitizer fluid onto the palm of a user's hand is shown in FIG. 11. According to the present exemplary embodiment, a user's hand, from the arm opposite of the arm having the wrist on which the dispenser 10 is attached, is placed over the holster 1 and pressed with a force that causes fluid 26 to expel from the valve 2 and onto the user's palm. The dispenser 10 may be attached on either wrist.

Approximately 0.5 cc of hand sanitizer in gel form may be required to fully coat one's hands. Given the number of times a user may encounter a situation where it would be advisable to cleanse one's hands during the day, the bladder 4 having a 15 cc capacity provides, at a minimum, a one day supply. Also, the bladder 4 is easy to replace or refill in situ without the use of special tools. To accomplish this, the bladder 4 is configured as a separable unit from the holster 1. Individual bladders can be carried or stored for later use.

Figure 12:
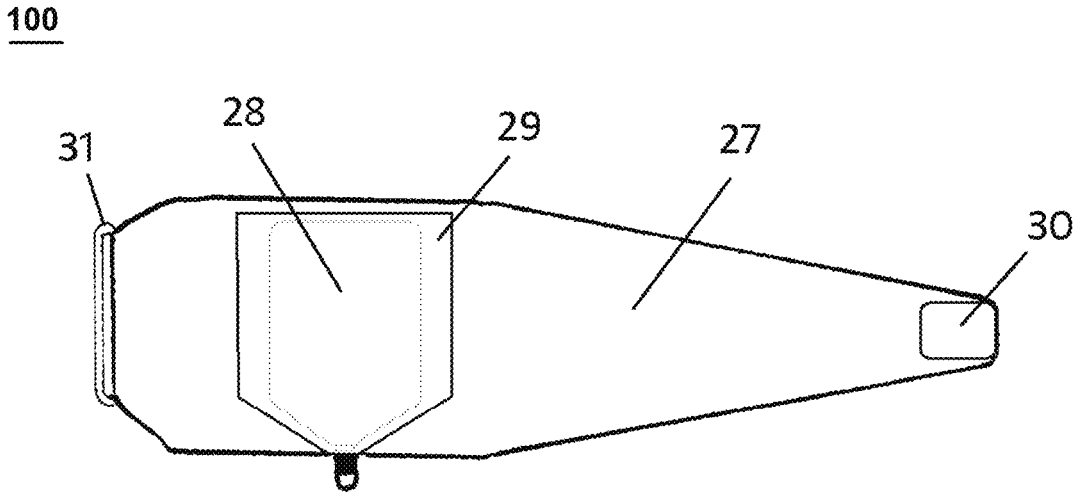
FIG. 12 is a top view of a dispenser according to an exemplary embodiment.
Figure 13:
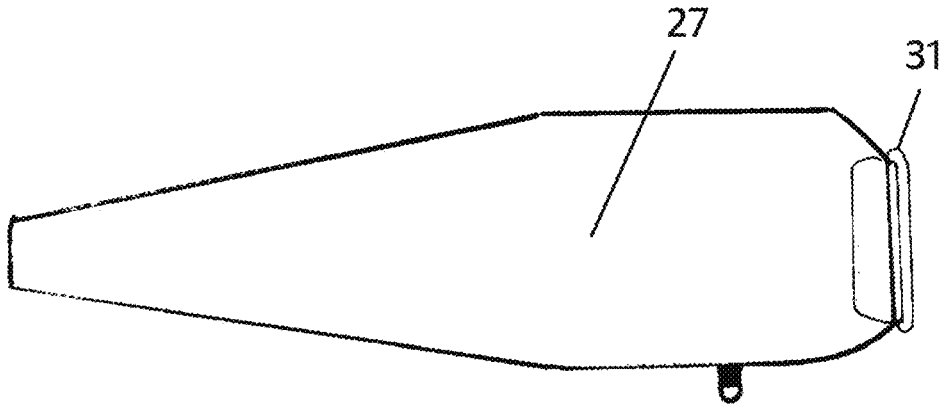
FIG. 13 is a bottom view of the dispenser of FIG. 13.

A dispenser 100 according to an exemplary embodiment is shown in FIG. 12 and FIG. 13. The dispenser 100 may be substantially the same as the dispenser 10 described above with respect to FIGS. 1 through 11 of the present application, and the disclosure thereof is incorporated herein by reference, and any repeated disclosure may be omitted for the sake of brevity. The dispenser 100 may be disposed after a single use, or when the reservoir therein is depleted. A base ply 27 is made from low-cost felt, paper/fiber, or personal protective equipment (PPE) material. A bladder pack 28 is completely sealed after being filled, eliminating a refill capability (such as described above with respect to the bladder 4), and the bladder pack 28 is positioned on the top side of the base ply 27. A second ply 29 used to enclose the bladder pack 28 and is affixed to the base ply 27 using weld or adhesive. A buckle 31 is made of a low-cost material such as plastic or steel. An attachment mechanism 30 may be hook and loop or a fastener similar to what is used on ACE™ bandages.

Figure 14:
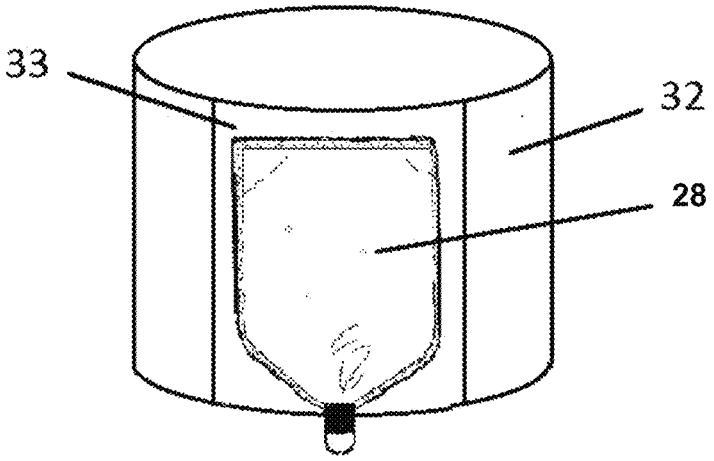
FIG. 14 is a perspective view of a dispenser according to an exemplary embodiment.

FIG. 14 shows a dispenser 200 according to an exemplary embodiment having a different method of attachment to a user than the dispenser 10 and dispenser 100. The dispenser 200 may be substantially the same as the dispensers 10 and 100 described above with respect to FIGS. 1 through 13 of the present application, and the disclosure thereof is incorporated herein by reference, and any repeated disclosure may be omitted for the sake of brevity. An outer band 32 is made of a spandex-type material attached to the ends of a pocket 33 made of non-stretchable fabric. A bladder pack 28 (or bladder 4, not shown), as described above, is arranged on the pocket 33.

Figure 15:
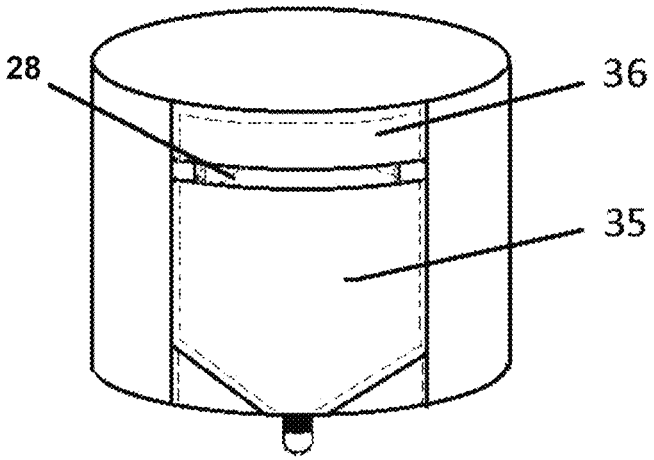
FIG. 15 is a perspective view of the dispenser of FIG. 15.

FIG. 15 shows the dispenser 200 with a pocket cover 35 and expandable retainer 36. The bladder pack 28 is disposed in a pouch formed between the pocket 33 and the pocket cover 35. The retainer 36 is connected to the pocket 33 and may be expanded or contracted to retain the bladder pack 28 in the pouch. The dispenser 200 is reversible, whereby a pouch opening, for inserting and removing the bladder pack 28, may be arranged on the inside of the dispenser 200, closer to a user's wrist.

FIG. 16*a*, FIG. 16*b*, FIG. 16*c* and FIG. 16*d* show a method for installing a valve 2 into a bladder 4 according to an exemplary embodiment. The valve and bladder are substantially similar to the valve and bladder described above with respect to the exemplary embodiment shown in FIGS. 1-7*b*, and the description thereof is incorporated herein by reference, and any repeated description thereof is omitted. Likewise, the description herein with respect to FIGS. 16*a*-16*d* is incorporated by reference in the exemplary embodiment shown with respect to FIGS. 1-7*b*. The method according to the present exemplary embodiment assures an adequate seal between bladder 4 and valve 2, thereby preventing leakage during use.

Figure 16A:
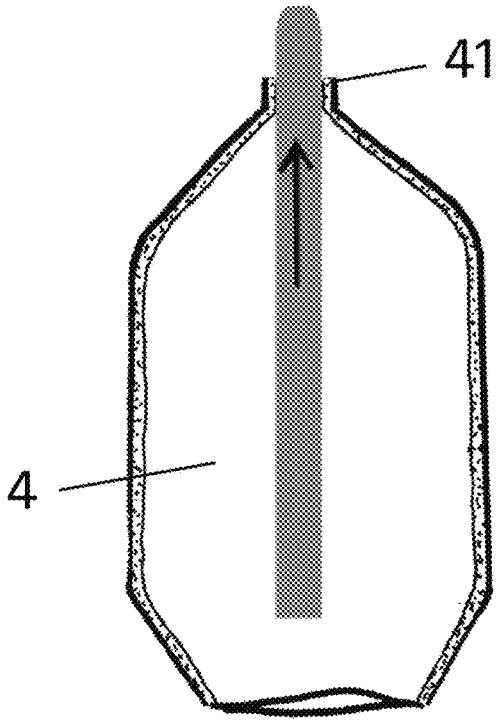
FIG. 16*a*, FIG. 16*b*, FIG. 16*c* and FIG. 16*d* show a method for installing a valve into a bladder according to an exemplary embodiment.
Figure 16B:
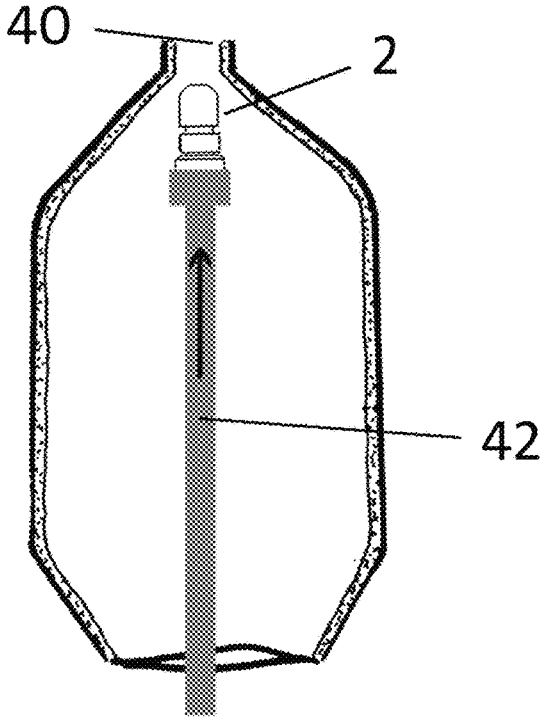
Figure 16C:
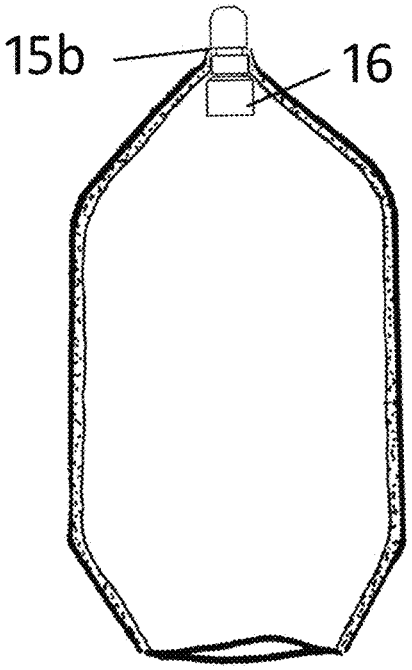
Figure 16D:
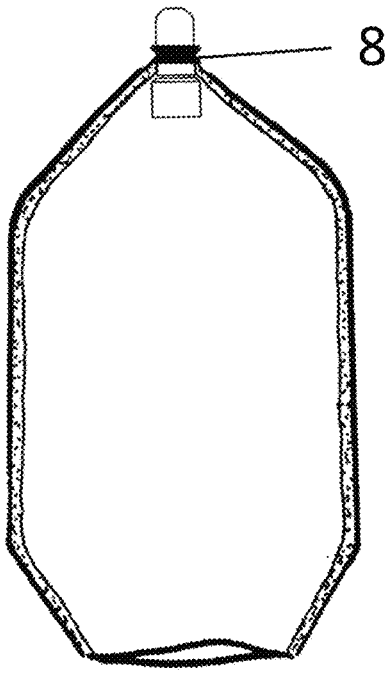

After the bladder 4 is formed by a heat weld technique, a round tipped dowel 41 with a diameter of 0.230 inch is forced through a channel 40 in order pre-stretch the channel prior to insertion of the valve 2, as shown in FIG. 16*a*. As shown in FIG. 16*b*, the valve 2 is seated using a second tool 42. The valve is in place when a valve cap 16 reaches the bottom of the bladder 4, as shown in FIG. 16*c*. A seal is made when shrink wrap tubing 8 is applied over the groove 15*b* and heated with forced hot air, as shown in FIG. 16*d*. This way, the bladder tip material is pulled into the groove 15*b* and held in place by the shrink wrap tubing 8.

In an age where shaking hands may now socially unacceptable, the ability to cleanse one's hands prior to and after performing a hand shake may allow future acceptance of this tradition. In order to help achieve adoption of a wrist-worn hand sanitizer dispenser, the dispensers described above with respect to the exemplary embodiments are designed to be comfortable to wear and conform to the shape of a user's wrist, such that the dispenser fits under a dress shirt and allows free movement of the wrist.

The dispensers according to the present exemplary embodiments provide a convenient method for applying hand sanitizer without the need for locating available wash stations at restaurants and commercial outlets or reaching into one's pocket or pocket book to retrieve and dispense a portable bottle of sanitizer. Retrieving a bottle of sanitizer could promote the spread of viruses onto personal items and clothing. In addition, it would not be convenient and not readily available for use wherever needed.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangement.

I claim:

1. A wrist-worn hand sanitizer dispenser packet, comprising:

a bladder comprising two-ply welded plastic or blow molded plastic;

a valve, unified at a first end thereof with the bladder, the valve comprising a spring and a ball pressed against a seat, the valve having a conduction path existing from the first end thereof to a second end thereof, and the valve having an adjustable pressure-sensitive fluid release spring chamber;

a fluid recharge opening in the bladder on an opposite side of the valve, the fluid recharge opening to permit refilling a fluid cavity in the bladder without the use of a special tool, wherein the bladder is prepared for sealing by applying at least one folded layer at the fluid recharge opening.

2. The wrist-worn hand sanitizer dispenser packet of claim 1, further comprising a tubular structure made of acetal, the tubular structure comprising a channel extending along the length thereof and acute flares formed at both ends of the channel, the tubular structure configured to retain the at least one folded layer.

3. The wrist-worn hand sanitizer dispenser packet of claim 2, wherein the tubular structure is configured to secure the at least one folded layer by sliding the tubular structure along a seam of the at least one folded layer, thereby providing a force sufficient to prevent fluid leakage along the fluid recharge opening of the bladder when pressure is exerted on the bladder.

4. A holster comprising a first layer and a second layer of textile material sewn together and a pocket that is sized to receive the wrist-worn hand sanitizer dispenser packet of claim 1, the holster configured to conform to a user's wrist such that the holster can be easily worn under a sleeve of a dress shirt.

5. The holster of claim 4, further comprising:

an extending flap that is routed through a buckle and directed back on itself; and a mating hook and loop fastener, the extending flap configured to connect to the mating hook and loop fastener.

6. The holster of claim 5, further comprising an opening at a bottom end of the pocket configured to allow the valve to exit the holster towards a user's palm.

7. The holster of claim 6, further comprising a flap disposed on an upper side of the holster, the flap configured to retain the wrist-worn hand sanitizer dispenser packet of claim 1 and allow easy access for removing or reloading a new wrist-worn hand sanitizer dispenser packet.

8. A disposable holster comprising:

a first layer and a second layer respectively comprising textile, paper or personal protective equipment material, the disposable holster having the wrist-worn hand sanitizer dispenser packet of claim 1 embedded between the first layer and the second layer; and the valve exposed through a bottom of the disposable holster, the valve directed towards a user's palm.

9. The disposable holster of claim 8, wherein the first layer and the second layer of the disposable holster are affixed to each other using heat welding, ultrasonic welding or an adhesive technique.

10. A holster comprising spandex material and a pocket comprising textile material having a flap sewn between a first layer and second layer of textile material and an opening configured to permit the valve to extend from the pocket for the purpose of retaining, installing and replacing the wrist-worn hand sanitizer dispenser packet of claim 1.

* * * * *